United States Patent [19]

Belanger et al.

[11] Patent Number: 4,523,705

[45] Date of Patent: Jun. 18, 1985

[54] MECHANISM FOR GLUE GUN

[76] Inventors: Richard W. Belanger, 25 Collins St., Amesbury, Mass. 01913; Peter S. Melendy, 11 Crestview Dr., Exeter, N.H. 03853

[21] Appl. No.: 458,218

[22] Filed: Jan. 14, 1983

[51] Int. Cl.[3] ..... B65H 17/26

[52] U.S. Cl. ..... 226/127; 226/167; 74/128; 74/141.5; 74/470; 222/391; 222/146.5

[58] Field of Search ..... 222/146 HE, 146 H, 323, 222/391, 339, 336, 470; 74/470, 128, 141.5; 226/164, 167, 127, 129, 130, 133; 228/52, 53

[56] References Cited

U.S. PATENT DOCUMENTS

| | | | |
|---|---|---|---|
| 2,647,412 | 8/1953 | Warmoes et al. | 74/470 |
| 3,377,012 | 4/1968 | Cushman | 228/53 |
| 3,743,142 | 7/1973 | Elliot et al. | 222/146 HE |
| 3,744,921 | 7/1973 | Weller et al. . | |
| 4,053,087 | 10/1977 | Lack et al. | 222/339 |
| 4,167,245 | 9/1979 | Kock et al. | 222/391 |
| 4,378,076 | 3/1983 | Stirnweiss | 222/146 HE |

FOREIGN PATENT DOCUMENTS

| | | | |
|---|---|---|---|
| 670973 | 4/1952 | United Kingdom | 222/53 |

*Primary Examiner*—H. Grant Skaggs

*Attorney, Agent, or Firm*—Berman, Aisenberg & Platt

[57] ABSTRACT

A mechanism is described which employs a safety element for preventing the application of excessive force to a linkage. In several embodiments the safety device comprises a spring which allows relative movement between a trigger and the linkage. The safety device may, however, be a mechanical fuse.

The inventive safety device is embodied in a hot glue gun so that the safety device prevents the application of excessive force to the linkage which advances glue. Damage to the glue gun is thus avoided.

Also disclosed is a unique return spring for a mechanism such as the glue gripper of a glue gun. The return spring allows rotation of the gripping element to occur before linear movement of the glue stick.

5 Claims, 6 Drawing Figures

MECHANISM FOR GLUE GUN

TECHNICAL FIELD OF THE INVENTION

This invention relates to mechanisms for advancing an element in response to an applied force. In particular the invention relates to a mechanism for advancing a stick of glue in a hot glue gun.

BACKGROUND ART

A hot glue gun is a tool for applying melted glue to a workpiece. The gun typically has an electric heating element for receiving a cylinder of solid glue. The solid glue is melted by the electric heating element as it passes through a heating chamber before being forced out of a nozzle for application to a workpiece. As the glue on the workpiece cools, the workpiece is secured to another object.

Mechanisms which advance the glue through the heating chamber and out of the nozzle are of two general types. The first type is that of a constant-pressure gun. In this mechanism a resilient element, typically a spring, applies a constant force to one end of the stick of glue. A valve in the nozzle prevents the glue from flowing through the nozzle until the valve is opened. The second kind of mechanism is an intermittent-pressure mechanism. This type of gun usually employs a trigger which must be squeezed to apply a force to advance the glue through the heating chamber and out of the nozzle.

The U.S. patent to Weller et al, U.S. Pat. No. 3,744,921, shows a hot glue gun of the constant-pressure type. In the Weller et al gun, a spring applies a continuous force to a plunger which applies pressure to a glue cylinder. A valve is located in the nozzle for automatic opening upon contact of the nozzle to a workpiece. When the valve is opened, melted glue flows through the nozzle and onto the workpiece.

STATEMENT OF THE INVENTION

Hot glue guns of the intermittent-pressure type are subject to damage when an excessive force is applied to the trigger. This may occur when the user of the gun attempts to force cold glue through a heating chamber which has not been given adequate time to reach the optimum temperature for operation of the gun. When the trigger is squeezed too tightly, an excessive amount of force is placed on the mechanism of the gun and it breaks, resulting in the gun's subsequent failure to operate. Furthermore, glue may be forced into the chamber too fast, thus causing glue to back-up and flow into other portions of the gun.

The solution to this problem has been merely to increase the size or strength of the internal mechanism. This approach results in a more expensive gun, since the parts must be larger than necessary for proper operation of the gun. Since the increased strength is effected by the use of stronger or thicker components, the cost of the gun rises with the increased cost of these materials.

Applicants have solved the prior art problems by providing an improved mechanism for transmitting the force from the trigger of a glue gun to a movable housing which advances the glue. This mechanism includes a safety element in series with components of the mechanism which operates to allow a first part of the mechanism to move with respect to the remainder of the mechanism until the first part engages a stop which can withstand an excessive force. Since the stop then receives the excessive force, the remainder of the mechanism is not damaged. The mechanism may thus be of materials which are of less strength and is, accordingly, less expensive to manufacture.

Another feature of the present invention is a unique return spring attached to a known glue gripping mechanism. This spring causes the gripper to pivot so as to grip the stick of glue when the glue housing is being advanced and to return the housing automatically when pressure on the trigger is released. The spring is placed so that the force operating on the gripper by a mechanism linking the trigger to the gripper necessarily causes rotation of the gripper relative to the housing before the housing moves forward in response to the force applied through the mechanism.

Prior art glue guns utilize drag springs, such as leaf springs, to create drag on the gripper housing so that a force applied to the gripper, which is pivotally attached to the housing, will pivot the gripper before movement of the housing begins. A separate return spring is attached to the housing or to the mechanism contacting the trigger. This arrangement requires a return spring and a drag-creating leaf spring, whereas the structure of the invention includes a single spring which acts to accomplish the purposes of the prior art elements.

DETAILED DESCRIPTION OF THE INVENTION

Figure 1:
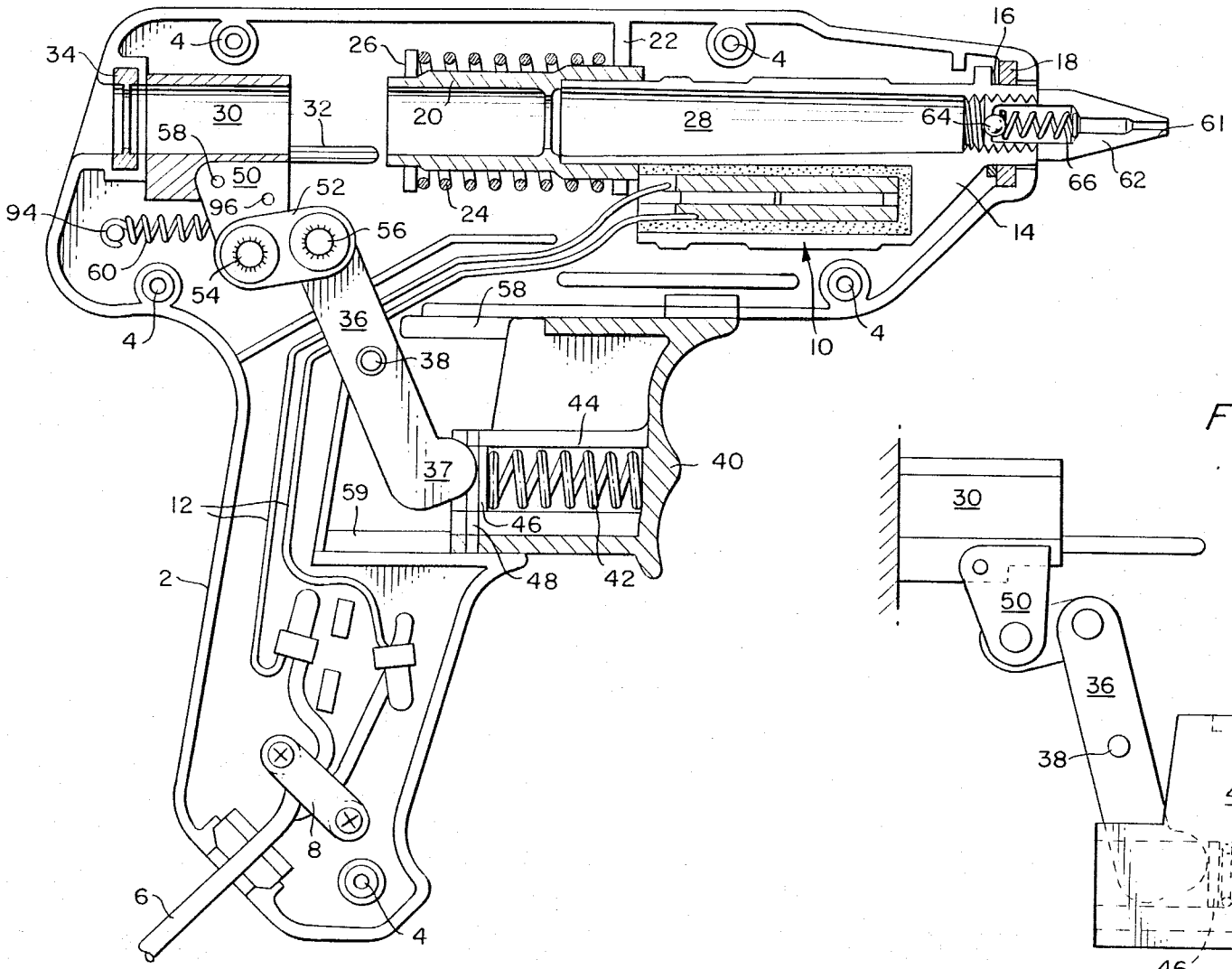
FIG. 1 is a view of the left half of the glue gun, showing the component parts.

FIG. 1 shows the left side 2 of a glue gun frame or handle. Screw holes 4 are provided for receiving screws to hold a right-hand portion of the glue gun frame to the left-hand portion 2. A power cord 6 is secured to the frame by a clamp 8, and electric power is supplied to the heating element 10 by way of leads 12. The construction of the heating element 10 is conventional. The heating element 10 is attached to a casting assembly 14. One end of the casting assembly 14 is secured to the frame by a ring 16 and an insulating element 18. Attached to the other end of the casting assembly 14 is a sleeve 20. The sleeve 20 is supported by a rib 22 which, in turn, supports the other end of the casting assembly. A spring 24 surrounds the sleeve 20 and assures a tight seal between the casting 14 and the sleeve 20. A rib 26 supports the rear end of the sleeve 20.

The casting assembly 14 has a hollow, tapered chamber 28 for receiving solid glue, which is to be melted by the heater element 10. A cylinder of hard glue is advanced into the hollow chamber 28 by a gripper housing 30. The housing 30 has tabs for riding in linear groove 32 which is formed in the handle 2. A stick of solid glue is inserted into the gripper housing through a hole in the frame having rear drag ring 34 therein. The drag ring prevents a glue stick from falling out of the gun, or from being pulled by the mechanism during the retraction of the mechanism.

The operation of the mechanism which advances the gripper housing will now be described with reference to FIG. 1. This mechanism is shown diagrammatically and separate from the remainder of the glue gun structure in FIGS. 2 and 3.

Lever 36 is pivotally mounted to the housing by a pin 38. The lower end 37 of the lever is in contact with a trigger assembly 40 through an inventive spring mechanism. A spring 42 is located within a housing 44 which is part of trigger 40. A disc 46 is located between the lower end 37 of the lever and the spring to facilitate contact between the lever and the spring. Embossment 48 retains the disc within the housing 44 and pre-loads the spring by holding it in a partially compressed condition. In a preferred embodiment the spring 42 is pre-loaded to about twenty pounds. The upper end of lever 36 is connected to a glue gripper 50 by a drag link 52. The drag link 52 is connected to gripper 50 by a pin 54 and to the upper end of the lever 36 by a pin 56.

The trigger 40 has tabs (not shown) which ride in grooves 58 and 59 to ensure that the trigger moves linearly. The grooves are of limited length and the ends of them act as stops to limit the travel of the trigger 40. The travel of gripper housing 30 is limited by the travel of the trigger 40.

As the trigger 40 is squeezed, the disc 46 engages the lower end 37 of lever 36, thus pulling the drag link 52 toward the right of FIG. 1. Gripper 50 is pivotally attached to the gripper housing at a pin 58 so that the gripper pivots relative to the housing 30 as the lever 36 is rotated in response to pressure on the trigger 40. This pivotal motion is caused by the action of a spring 60 which will be described below. After the gripper 50 rotates to engage a stick of glue located in the housing 30, the housing 30 begins to move to the right of FIG. 1 by riding in the groove 32. The glue is thus advanced into the chamber 28, melted glue is forced through hole 61 in nozzle 62 by forcing the ball 64 from its seat. When pressure on trigger 40 is released, the spring 66 forces the ball 64 onto the nozzle seat, thus stopping the flow of melted glue from the chamber through the nozzle 62.

In normal operation of the gun, the pressure applied to the trigger 40 is just sufficient to expel melted glue from the chamber 28 through the nozzle 62 by movement of the gripper housing 30. During normal operation the spring 42 appears solid because the pre-loaded force is greater than normally required operating forces. If the glue is not capable of flowing through the nozzle 62, as for example when the glue has not yet achieved the optimum operating temperature, it is common for the operator of a glue gun to apply an excessive force to the trigger in an attempt to force the non-flowing glue out of the nozzle. In the inventive mechanism, the spring 42 compresses when the force applied to the trigger is larger than that which is ordinarily necessary for forcing melted glue out of the nozzle. This ensures that the mechanism which moves the glue, and the chamber 28 are not damaged due to excessive force.

Figure 2:
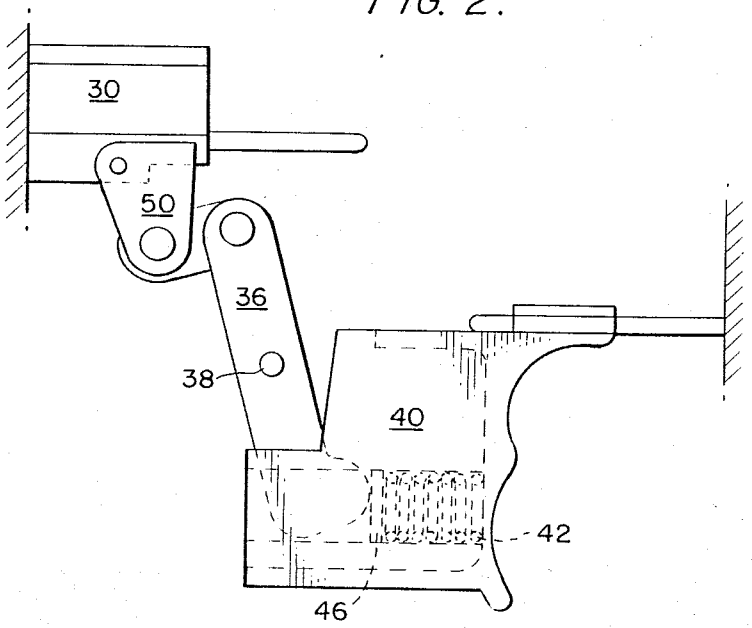
FIG. 2 is a diagrammatic view of the glue-advancing mechanism of the invention shown in FIG. 1 in an over stressed condition.

FIG. 2 shows a diagrammatic view of the mechanism when an excessive force has been applied to the trigger. The spring 42 merely compresses to allow the spring to advance to the stops at the end grooves 58 and 60, thus accepting the force on the trigger and preventing an excessive force from being applied through the mechanism to the gripper housing. In a preferred embodiment the spring will be fully compressed by a force of twenty-eight pounds; thus, this is the maximum force which can be transmitted by the mechanism.

Figure 3:
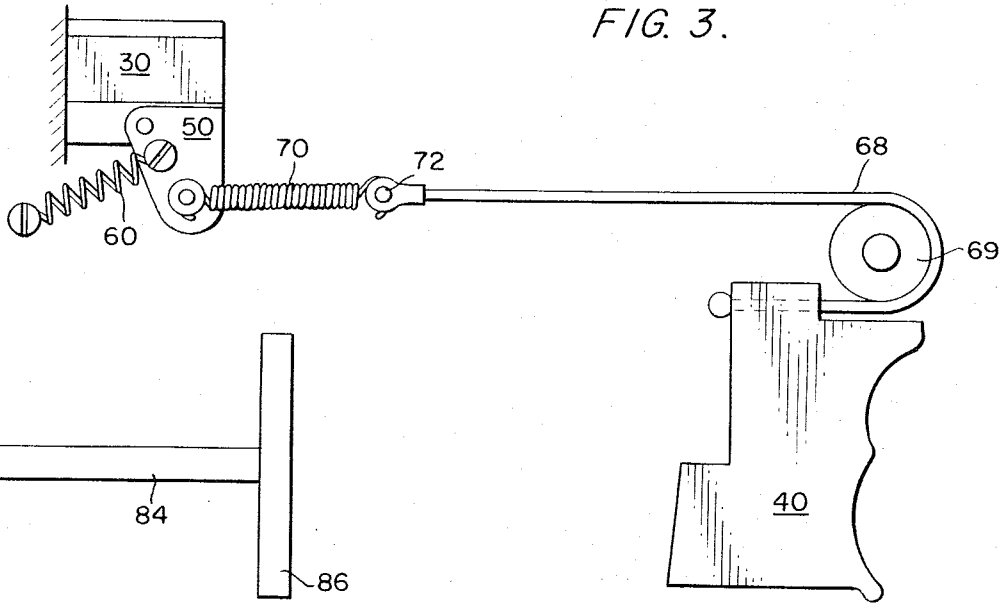
FIG. 3 is a diagrammatic view of a second embodiment of the glue-advancing mechanism of the invention.

FIG. 3 shows a second embodiment of a mechanism which may be used to advance the gripper housing. The trigger 40 is connected a cable 68. The cable extends from the trigger 40 around a pulley 69 to the gripper 50. When pressure is applied to the trigger 40, the glue gripper housing 30 is advanced in the same manner as described with respect to FIG. 1. A spring 70 is placed between the terminal portion 72 of the cable and the glue gripper 50. In a manner similar to the operation of the mechanism shown in FIG. 1, if an excessive force is applied to the trigger 40, the spring 70 will extend allowing the trigger 40 to advance to the ends of grooves 58, 59 or other appropriate stops to thereby prevent the excessive force from being applied to the remainder of the mechanism. Subsequent damage to the various parts of the glue gun is thus avoided.

Figure 4:
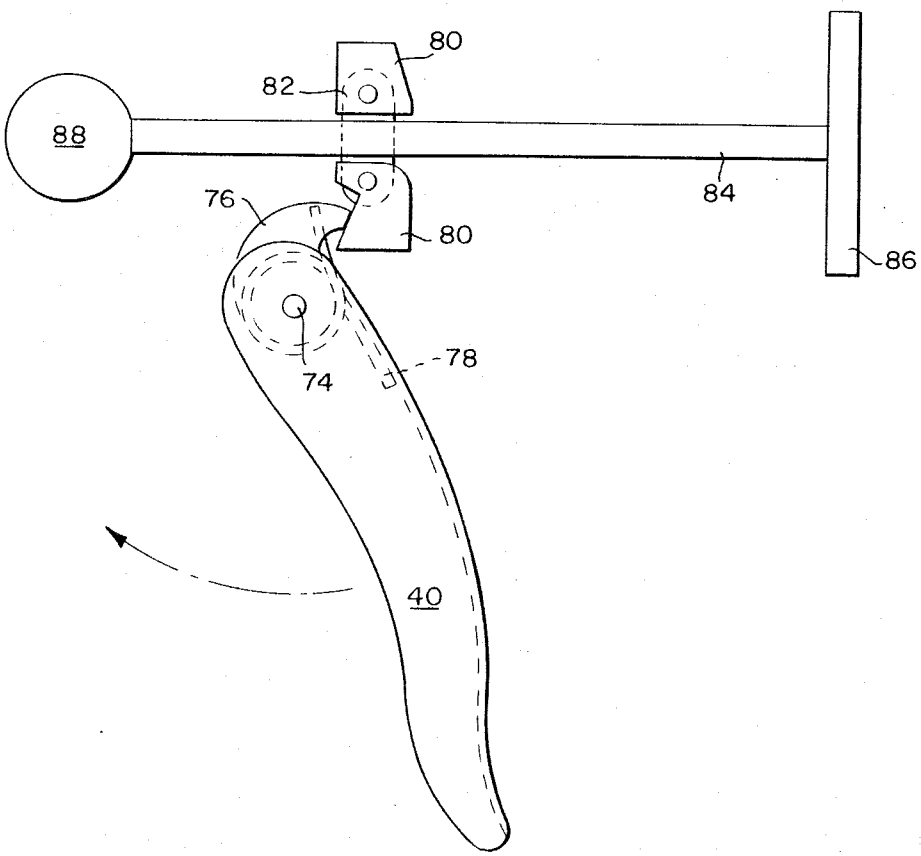
FIG. 4 is a diagrammatic illustration of a third embodiment of a glue-advancing mechanism according to the invention.

FIG. 4 diagrammatically shows another embodiment wherein a trigger 40 is pivotally mounted about a pin 74. A contact element 76 is pivotally mounted about the pin 74 also and is secured to the trigger 40 by means of a torsion spring 78. The torsion spring is designed to provide a fixed position of trigger 40 with respect to the contact element 76 for normal pressures on the trigger 40. Under these circumstances, the contact mechanism 76 pushes against one of two feed blocks 80 which are connected by a link 82. The feed blocks contact a feed rod 84 having a plunger 86 at one end thereof which in turn contact the solid glue. When the feed rod is advanced in response to pressure on the trigger 40, glue is forced through the chamber 28 and melted glue is forced out of the nozzle 62. A stop 88 is located at one end of the rod 84 to limit the longitudinal movement of the rod.

When an excessive force is applied to the trigger 40, shown in FIG. 4, the torsion spring 78 allows the trigger 40 to rotate with respect to the contact element 76 preventing transmission of the excessive force to the remainder of the mechanism and thus preventing damage to the gun.

While the safety elements which prevent the application of an excessive force to the mechanisms have been shown as springs, it should be understood that many other resilient elements may be employed. Furthermore, it may be that it is desirable to use a mechanical fuse in place of the springs shown in the Figures. In this case, the spring 42, 70, or 78 would be a breakable element which would simply break when an excessive force is applied to the trigger. For example, spring 42 shown in FIG. 1 may be coiled plastic which breaks when an excessive force is applied. The fuse may then be replaced, and the remaining elements of the gun will be undamaged.

Figure 5A:
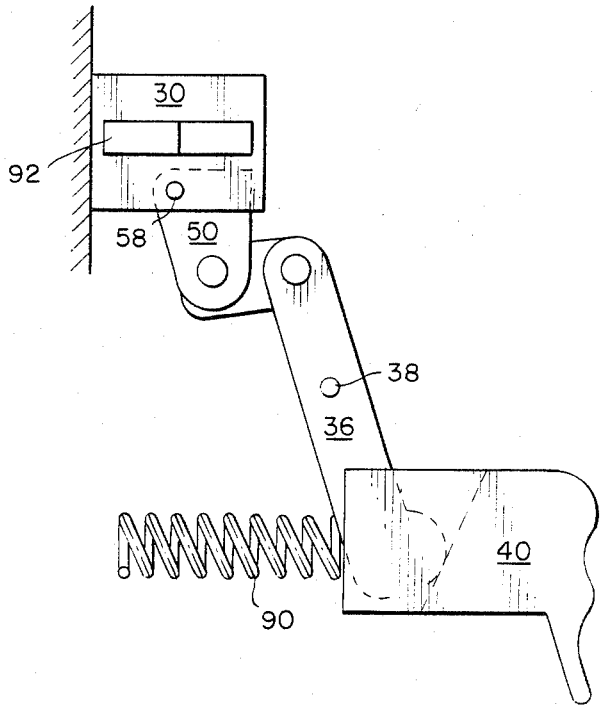
FIG. 5A. (PRIOR ART)
FIGS. 5*a* and 5*b* are diagrammatic illustrations of a prior art glue-advancing mechanism.
Figure 5B:
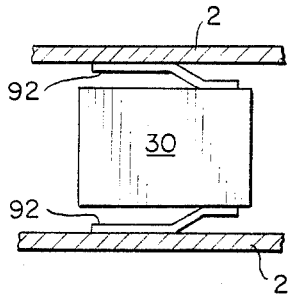
FIG. 5B. (PRIOR ART)

A second feature of the inventive glue gun will be described with respect to FIGS. 5*a* and 5*b*. These Figures show a prior art mechanism for advancing glue through the glue gun. As seen in FIG. 5*a*, a trigger 40 is in direct contact with a lever 36 which is connected to a gripper 50. Because of the direct contact, excessive force on the trigger 40 will damage the gun by transmitting the excessive force to the housing 30. A return spring 90 is employed to return the trigger 40 and the lever 36 to a rest position after pressure on the trigger 40 has been released. Drag springs 92 are located on either side of the housing 30 to squeeze the housing 30 between the left and right halves of the handle 2. The springs create a frictional drag on the housing 30 so as to ensure that the gripper 50 will pivot about the pin 58 as the trigger 40 is squeezed. As explained above, the pivoting of the gripper 50 results in the gripper engaging the stick of glue so as to ensure that the glue moves with the housing 30. When pressure on the trigger 40 is released, the return spring pivots the lever 36 about the pin 38 and thus the gripper 50 pivots about the pin 58 in a direction opposite to that when the trigger is being squeezed. This releases the gripper 50 from the glue and allows the housing 30 to reset itself while leaving the stick of glue stationary. When the trigger 40 is again squeezed, the gripper takes a new grip on the stick resulting in a rachet-type action of the housing 30.

Applicant's return spring 60, shown in FIG. 1, replaces both of the prior art elements 90 and 92. One end of the spring 60 is attached to the handle 2 at an anchor 94. The other end of the return spring 60 is attached to the gripper at a pin 96. The pin 96 is located closer to pin 58 that is pin 54. The return spring 60 forces the gripper 50 to rotate about the pin 58 upon application of pressure to the trigger 40. After the gripper has engaged the glue, the gripper 50 will cease to rotate and the housing 30 will move along the groove 32 to advance the glue into the chamber 28. Upon release of pressure to the trigger 40, the return spring 60 will cause the gripper 50 to rotate in an opposite direction and will subsequently cause the housing 30 to return to its rest position.

The return spring requires the rotation of the gripper 50 because of the relative locations of the pins 54, 58, and 96. The forces on the pins 54 and 96 may be resolved into components parallel to the groove 32 and perpendicular to a line connecting pin 58 with pin 54 and a line connecting pin 58 with pin 96. It will be seen that the force on pin 54 parallel to groove 32 must be equal to or greater than the force on pin 96 parallel to groove 32 in order for housing 30 to advance glue to the chamber 28. It will also be seen that since pin 54 is further from pin 58, the lever arm is longer and the component of force causing rotation of gripper 50 may be much less at pin 54 than at pin 96. Thus, rotation of the gripper 50 will occur before the housing 30 begins to move because the component causing rotation need only be approximately one-half the force causing rotation on pin 96, while the component causing linear motion of the housing 30 must be equal to the component causing linear motion of housing 30 on pin 96. The spring 94 is pre-loaded to require a minimum force on trigger 40 to begin operation of the gun.

It is claimed:

1. In a mechanism for gripping an element and moving it in a first direction, the combination of (a) handle means (b) housing means mounted on said handle means for contacting said element and carrying said element in said first direction, (c) grip means pivotally mounted to said housing means at a pivotal connection for gripping said object upon rotation about said connection, (d) means for applying a first force to said grip means at a first location for rotation said grip means and for moving said housing in said first direction, (e) means extending between said handle means and a second location on said grip means for applying a first torque and a second force in a second direction opposite to said first direction to said grip means, said first torque being less than a second torque applied to said grip means by said first force, whereby said grip means rotates upon application of said first force before said housing moves in said first direction and said housing moves in a second direction opposite to said first direction upon cessation of said first force.

2. The mechanism of claim 1 wherein said means extending between said grip means and said handle means is a spring, and the distance between said pivotal connection and said second location is less than the distance between said pivotal connection and said first location.

3. A mechanism according to claim 1 further comprising trigger means for actuation by an operator and safety means between said trigger means and said means for applying a first force, wherein said safety means transmits an operator force applied to said trigger means to said means for applying a first force when said operator force is smaller than a predetermined amount and transmits a limited force when said operator force is greater than said predetermined amount.

4. A mechanism according to claim 3 wherein said safety means is a pre-loaded compression spring.

5. A mechanism according to claim 3 wherein said safety means is a tension spring.

* * * * *